US008535452B1

(12) United States Patent
Gonzalez

(10) Patent No.: US 8,535,452 B1
(45) Date of Patent: Sep. 17, 2013

(54) AUTOMATED PIPE CLEARING APPARATUS

(71) Applicant: AGCG Investments, Inc., Tampa, FL (US)

(72) Inventor: Alejandro Gonzalez, Tampa, FL (US)

(73) Assignee: AGCG Investments, Inc., Tampa, FL (US)

( * ) Notice: Subject to any disclaimer, the term of this patent is extended or adjusted under 35 U.S.C. 154(b) by 0 days.

(21) Appl. No.: 13/789,224

(22) Filed: Mar. 7, 2013

(51) Int. Cl.
*B08B 9/00* (2006.01)
*B08B 9/035* (2006.01)

(52) U.S. Cl.
USPC ..... 134/166 C; 134/167 C; 134/168 C; 134/169 C

(58) Field of Classification Search
USPC ..... 134/166 C, 166 R, 167 C, 167 R, 134/168 C, 168 R, 169 C, 169 R
See application file for complete search history.

(56) References Cited

U.S. PATENT DOCUMENTS

| | | | | | |
|---|---|---|---|---|---|
| 4,962,778 | A * | 10/1990 | Driskill | 134/169 C |
| 5,085,244 | A * | 2/1992 | Funk | 137/240 |
| 5,722,458 | A * | 3/1998 | Potter | 137/625.47 |
| 6,041,611 | A * | 3/2000 | Palmer | 62/286 |
| 6,068,023 | A * | 5/2000 | Potter | 137/625.47 |
| 6,427,458 | B1 * | 8/2002 | Fowler | 62/150 |
| 6,442,956 | B1 * | 9/2002 | Herren | 62/150 |
| 6,701,740 | B1 * | 3/2004 | Hernandez-Zelaya | 62/291 |
| 6,706,518 | B2 * | 3/2004 | Lorenz et al. | 435/264 |
| 6,708,717 | B1 * | 3/2004 | Coogle | 137/240 |
| 6,892,907 | B2 * | 5/2005 | Varney | 222/527 |
| 6,976,367 | B2 * | 12/2005 | Spanger | 62/129 |
| 7,392,658 | B1 * | 7/2008 | Hardy, III | 62/78 |
| 7,624,756 | B1 * | 12/2009 | Coogle | 137/558 |
| 7,857,004 | B2 * | 12/2010 | Pearson | 137/899 |
| 2002/0023875 | A1 * | 2/2002 | Lorenz et al. | 210/601 |
| 2002/0157708 | A1 * | 10/2002 | Goff | 137/238 |
| 2005/0005625 | A1 * | 1/2005 | Lee | 62/285 |
| 2005/0138939 | A1 * | 6/2005 | Spanger | 62/150 |
| 2006/0042292 | A1 * | 3/2006 | Kimbrough et al. | 62/285 |
| 2011/0308546 | A1 * | 12/2011 | Kaiser | 134/18 |

* cited by examiner

*Primary Examiner* — Michael Barr
*Assistant Examiner* — Benjamin L Osterhout
(74) *Attorney, Agent, or Firm* — Andriy Lytvyn; Smith & Hopen, P.A.

(57) ABSTRACT

An automated pipe clearing apparatus for extracting buildup from a pipe. The apparatus includes a housing with an open bottom. The housing contains a discharge conduit adapted to fluidly couple to a drain pipe. A door is disposed within the housing, whereby the door can transition between an open and a closed positions. In the open position, the drain pipe drains normally through the discharge conduit. In the closed position the discharge conduit is slealingly enclosed within the housing. A vacuum pump, an electrical power source, and a switch module reside within the housing. The switch module actuates the vacuum pump and the door at predetermined times. When the door is in its closed position, the vacuum produced within the housing by the vacuum pump extracts buildup from the drain pipe. After the scheduled clearing is completed, the switch module causes the vacuum pump to turn off. The door returns to the open position, in which it remains until the next scheduled clearing.

15 Claims, 7 Drawing Sheets

AUTOMATED PIPE CLEARING APPARATUS

BACKGROUND OF THE INVENTION

1. Field of the Invention

This invention relates to pipe clearing devices. More specifically, it relates to an automated device for prophylactically clearing a pipe at predetermined times.

2. Brief Description of the Related Art

In almost every technological application, periodic preventive maintenance reduces the need for repairs and extends the life of equipment. This axiom holds true for the preventive maintenance of the fluid-carrying pipe systems. Specifically, a very prevalent problem associated with the central air conditioning and commercial refrigeration units is due to clogged drain pipes. The clogs are often caused by accumulation of dust, sludge, mold, algae, fungus, or a combination thereof within a drain line. A clogged pipe that is not detected in due time may overflow, causing extensive water damage to drywall and wooden beams. Overflowing drain pipes may also create health hazards by facilitating mold growth and producing foul odors inside the building.

Air handlers are commonly positioned in attics, where overflowing drain pipes may go unnoticed for a prolonged period of time. Often, the problem visually manifests itself only after the insulation and the ceiling are thoroughly soaked with the overflowing water, at which point, the damage may be substantial. Even upon detection of problems caused by a clogged overflowing drain pipe, the solution is not always simple or even apparent to many homeowners. A service call to a professional technician is one way of resolving the issue, but it may come at a fairly steep price. Moreover, the damage already caused by the overflowing water prior to detection of the problem may necessitate costly repairs.

Many expert technicians advise that periodic preventive maintenance is the most effective method for preventing the drain pipe from becoming clogged. Several techniques and devices are known in the art for prophylactically clearing out a pipe. Manually attaching an electric or mechanical vacuum pump to the outlet of the pipe and utilizing the suction to dislodge and remove debris is perhaps the most common technique of clearing a pipe. Some currently available technologies, such as the rod-and-piston device disclosed in U.S. Pat. No. 6,427,458, require a fair amount of manual labor. Moreover, to be fully effective, preventive pipe clearing must be performed on a regular basis. Clearly, such preventive maintenance may be a time-consuming, dreadful, and burdensome task. Accordingly, what is needed is an automatic pipe clearing apparatus that prophylactically clears the pipe without interfering with the pipe's normal drainage.

SUMMARY OF THE INVENTION

The long-standing but heretofore unfulfilled need for an automatic pipe clearing apparatus for prophylactically clearing a pipe without disrupting its normal operation is now met by a new, useful, and nonobvious invention.

In one embodiment, the automatic pipe clearing apparatus has a housing with an open bottom. The apparatus is adapted to connect to an existing drain pipe outlet, specifically condensate drain pipes of air conditioning and refrigeration systems. The housing optionally includes an integrated fitting adapted for this purpose. A door is rotationally, pivotally, or slidingly attached within the housing. Possible means of rotational attachment include circular channels disposed on the inner surface of the housing receiving annular ends of the rotating door. A hinge may be used to pivotally dispose the door within the housing. While grooves or channels may be utilized to allow the door to slide within the housing.

The door transitions between two positions: an open position and a closed position. The length and width of the door are essentially the same as the length and width of the open bottom. When the door is in the open position, the pipe drains as it normally would. However, when the door is in the closed position, the pipe is sealingly enclosed within the housing.

An electrical power source, a switch module, and a vacuum pump are contained within the housing. The air intake of the vacuum pump is within the housing, while the air outlet is outside the housing. The electrical power source supplies electrical current to the switch module and the vacuum pump. The switch module is adapted to actuate the vacuum pump at predetermined times for a predetermined duration.

When the door is in the closed position, the housing is essentially sealed, and the only source of air intake is the outlet of the pipe to which the apparatus is attached. Gaskets may optionally be disposed on the door or the inner surface of the housing to improve the seal between the door and the housing. Accordingly, when the vacuum pump is operating while the door is closed, the suction produced by the vacuum pump essentially creates a vacuum within the housing dislodging and extracting debris, mold, algae, and other buildup from the pipe.

In an embodiment, the door has a first annular end, a second annular end, a semi-cylindrical hollow body, and a center axis. The door rotates about the center axis to transition between the open and the closed positions.

In an embodiment, an electric motor is placed within the housing and is also powered by the electrical power supply. The electric motor is in mechanical communication with the door, whereby the electric motor may transition the door between the open and closed positions.

In an embodiment, the switch module may be adapted to automatically control the electric motor to synchronize the operation of the vacuum pump with the door, so that the vacuum pump operates when the door is in the closed position.

In an embodiment, the door in controlled using vacuum pressure. In this embodiment, the vacuum pump has two air intakes. The second air intake is fluidly coupled to a tube, in which a piston is slidingly disposed. When the second air intake is operating, a vacuum is created inside the tube causing the piston to move up within the tube. The piston is in mechanical communication with the door, wherein the door closes as the piston rises. When the door is in its closed position, the suction of the first air intake clears the pipe.

In an embodiment, the door may be urged toward the open position by a biasing element, such as a coil spring.

In an embodiment, the door may be hingedly connected to the housing. When the door is in the open position, the drain flow exits the housing through the bottom opening thereof. When the vacuum pump is actuated, the suction produced by the vacuum pump causes the door to pivot upwards until the lower member engages a bottom edge of the housing, thus enclosing the pipe outlet within the housing. Since the housing is sealed, the only air intake available is through the outlet of the pipe, which enables the vacuum pump to remove the buildup from the pipe.

The electrical power source utilized by the pipe clearing apparatus may be a battery, an alternating electrical current source, and a capacitor. A solar panel may be used to charge the battery.

In an embodiment, the pipe clearing device may include a temperature sensor that would prevent the device from actuating when the outside temperature is below freezing.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1A:
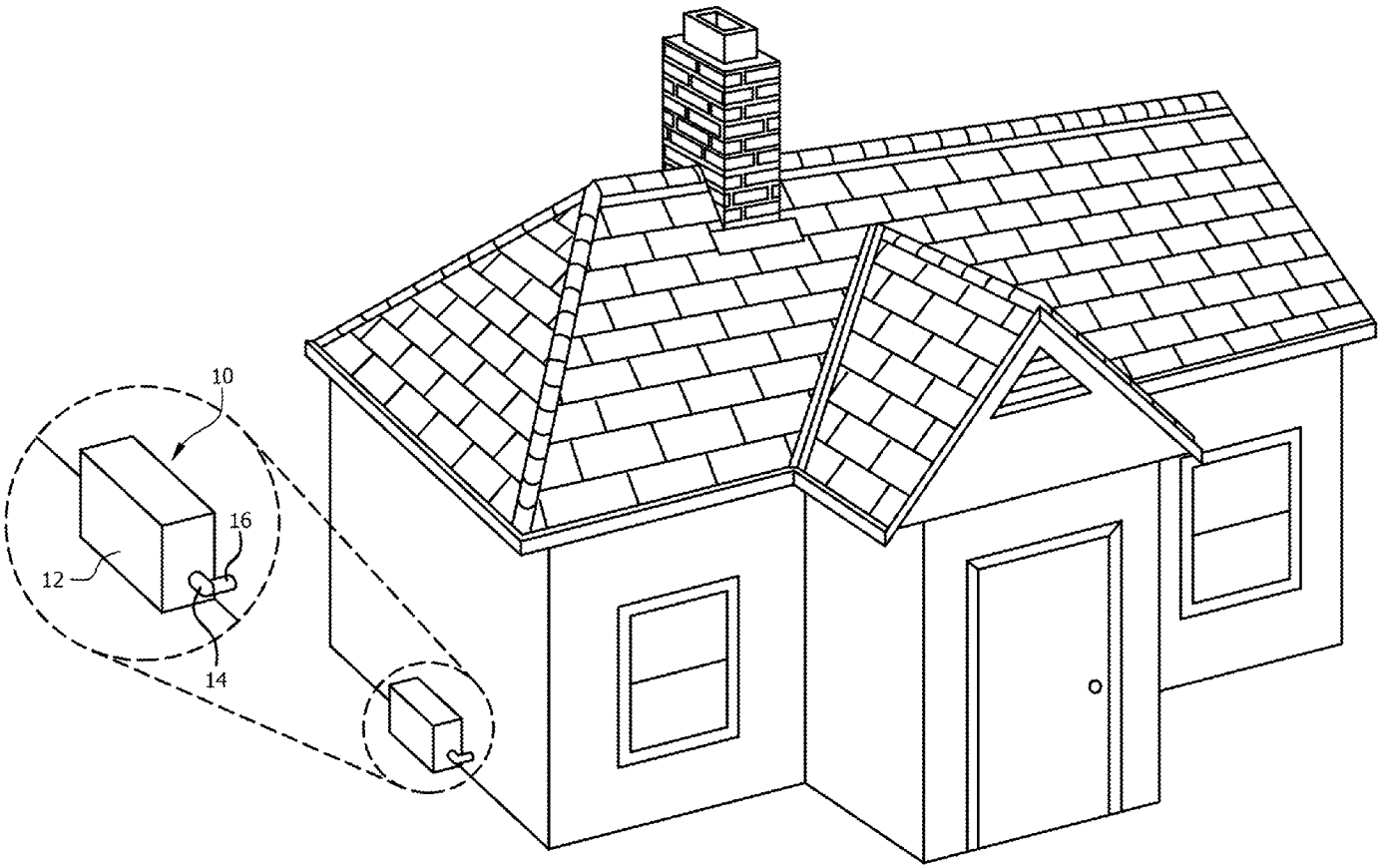
FIG. 1A depicts the automatic pipe clearing apparatus attached to an exterior wall of a building.
Figure 1B:
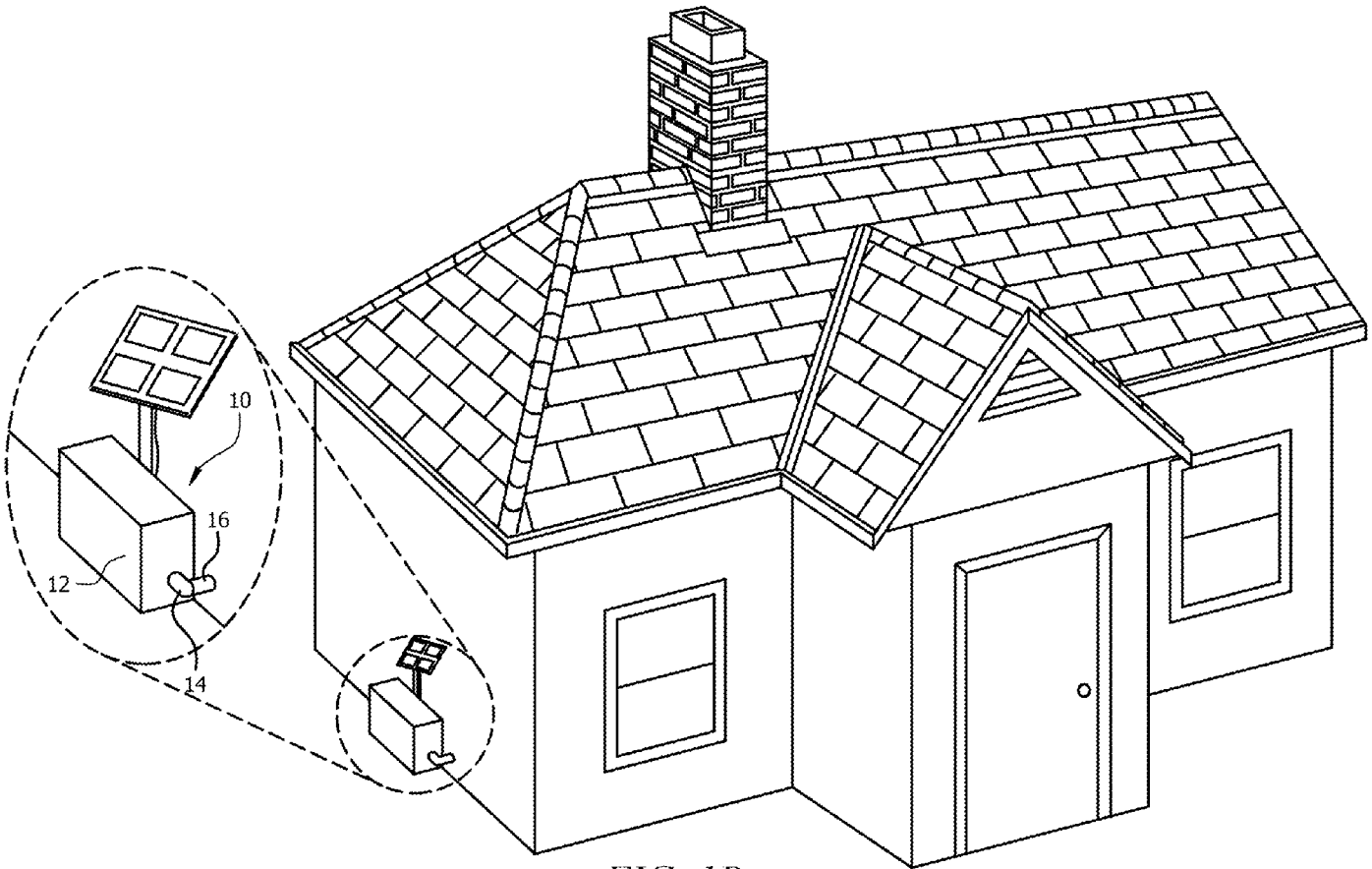
FIG. 1B depicts an embodiment of the automatic pipe clearing apparatus with a solar panel attached to an exterior wall of a building.

Referring to FIGS. 1A and 1B, a pipe clearing apparatus 10 is shown in an attachment to an exterior wall of a house. The exemplary embodiment depicted in FIGS. 1A and 1B is intended for clearing out condensation drain pipes of central air conditioning (hereinafter "AC") units and refrigeration systems. However, pipe clearing apparatus 10 may also be adapted for clearing out other types of draining, venting, and exhaust systems.

As depicted in FIGS. 1A and 1B, pipe clearing apparatus 10 fixedly attaches to an exterior wall of a building. The attachment may be accomplished via any means commonly used in the art, including fasteners and adhesive. Housing 12 of pipe clearing apparatus 10 contains a discharge conduit 14 adapted to fluidly couple with a condensation drain pipe 16 of an AC unit. In most buildings equipped with central AC units, condensation drain pipe 16 protrudes from a lower part of an exterior wall allowing the condensate to drain outside the building. Accordingly, pipe clearing apparatus 10 may be easily retrofitted into an existing system without any major modifications to the system itself.

Referring to FIGS. 2 and 4-6, housing 12 has a top surface and a lateral surface, and it is open on the bottom. Housing 12 is preferably of a water impermeable and noncorrosive material, such as plastics. Some examples include polyethylene, polypropylene, polyethylene terephthalate, polyvinylchloride, polyvinylidenechloride, polycarbonate, polyurethane, polyamide, polytetrafluoroethylene, and polyvinylacetate. Noncorrosive metals such as titanium, stainless steel, and alloys thereof may also be used. However, plastics are preferred due to low cost, low weight, and easy of manufacturing.

Referring to FIGS. 1A-B and 2A-B, outlet of drain pipe 16 is fluidly coupled to discharge conduit 14, which is fluidly coupled housing 12. Discharge conduit 14 may optionally include an extension 18 with an outlet 19 to divert the flow of condensate away from the walls of housing 12 helping to prevent possible water damage to the components contained within housing 12.

Figure 2A:
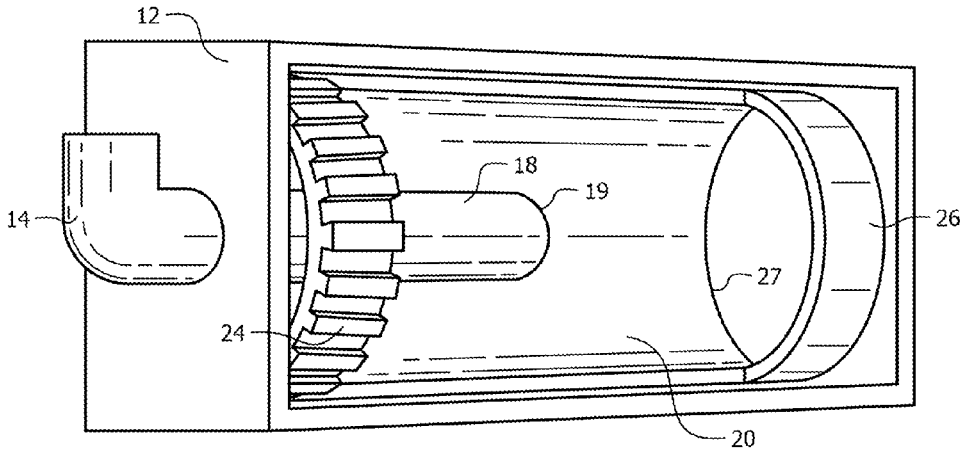
FIG. 2A is a perspective view of the bottom opening of the pipe clearing device with the rotating door in an open position.
Figure 2B:
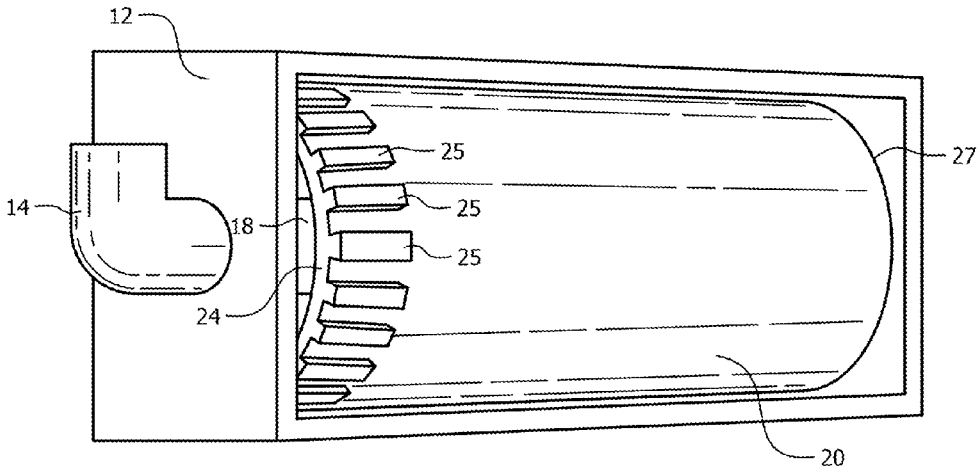
FIG. 2B is a perspective view of the bottom opening of the pipe clearing device with the rotating door in a closed position.
Figure 2C:
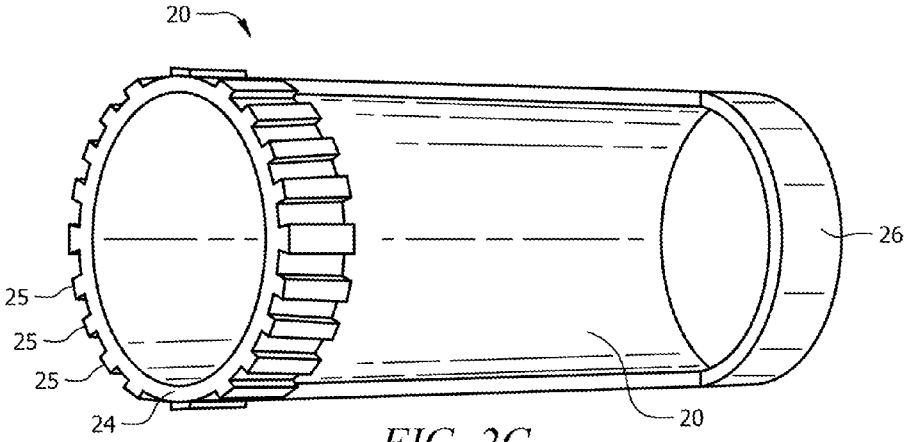
FIG. 2C is a perspective view of the door.

In one embodiment, a door 20 is rotationally disposed within housing 12 as shown in FIGS. 2A-B. Door 20 is depicted in greater detail in FIG. 2C. Door 20 comprises a semi-cylindrical hollow body 22, a first annular end 24, and a second annular end 26. Gear teeth 25 are disposed around the circumference of first annular end 24. In an alternative embodiment, gear teeth 25 may be disposed on the inner or lateral surface of first annular end 24 to reduce exposure of gear teeth to dust, debris, moisture, and other environmental elements that may form a buildup between gear teeth 25. Moreover, it is preferred that housing 12 includes an internal panel that would sealingly cover first annular end 24. Housing 12 contains circular grooves 27 adapted to engage inner surfaces of first and second annular ends 24 and 26, whereby door 20 may rotate about its central axis within housing 12.

Door 20 is capable of rotating between an open position depicted in FIG. 2A and a closed position depicted in FIG. 2B. Referring to FIG. 2A, in its open position, door 20 does not discharge conduit 14, therefore, allowing normal drainage of the condensate. When pipe clearing device 10 is not operating, door 20 is always open allowing condensate to freely drain from discharge conduit due to gravity as it normally would.

To transition from the open position shown in FIG. 2A to the closed position shown in FIG. 2B, door 20 rotates by essentially 180 about its central axis. In the closed position, door 20 closes the bottom opening of housing 12 forming essentially a sealed interior space within housing 12, wherein the only significant air inlet is discharge conduit 14.

The width and length of door 20 are essentially the same as the inner width and length of the bottom opening of hosing 12. Accordingly, in both closed and open positions, semi-cylindrical hollow body 22 of door 20 essentially seals the inner space of housing 12, preventing moisture, debris, and pests from entering housing 12. Housing 12 may further contain interior panels sealingly enclosing components housed within housing 12 to further protect them from exposure to the environmental elements.

Figure 3:
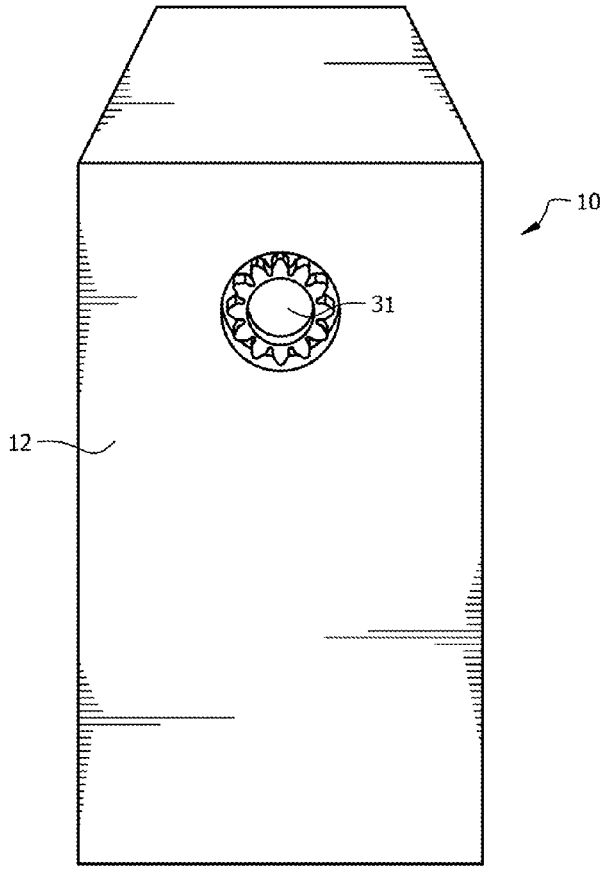
FIG. 3 is a perspective side view of the housing depicting the outlet of the vacuum pump.

In all embodiments of pipe clearing device 10 depicted in FIGS. 3-6, an electric vacuum pump 30 is disposed within housing 12. Referring to FIG. 3, housing 12 contains an opening adapted to allow outlet 31 of vacuum pump 30 to be in fluid communication with the exterior of housing 12. Outlet 31 allows the air pumped by vacuum pump 30 to exit housing 12.

Vacuum pump 30 is actuated at predetermined times to clear out pipe 16. While pipe 16 is being cleared, door 20 is in its closed position depicted in FIG. 2B, sealingly enclosing discharge conduit 14 within housing 12. Accordingly, the only source of air intake inside housing 12 is through discharge conduit 14. When vacuum pump 30 is operating, the vacuum created within the housing extracts debris, sludge, fungus, and other buildup from pipe 16 through discharge conduit 14, thus clearing the pipe to prevent clogging.

The debris that is removed by vacuum pump 30 is retained within semi-cylindrical hollow body 22 of closed door 20. After vacuum pump 30 has been operating for a predetermined duration, vacuum pump 30 turns off, and door 20 rotates back into its open position. As door 20 completes its rotation, the debris extracted from drain pipe 16 that was retained within semi-cylindrical hollow body 22 is ejected by the gravitational force. Pipe clearing device 10 remains in this configuration with door 20 in the open position until the next scheduled operation. The condensate continues to drain normally through discharge conduit 14.

It is envisioned that in some climates pipe clearing apparatus 10 may not be operational in freezing temperatures due to a possibility of door 20 being frozen. Accordingly, to prevent damage to the door-actuating mechanism, pipe clearing apparatus 10 may further include a temperature sensor in electrical communication with switch module 38, preventing switch module 38 from actuating pipe clearing apparatus 10 when the outside temperature is below the freezing point.

Figure 4:
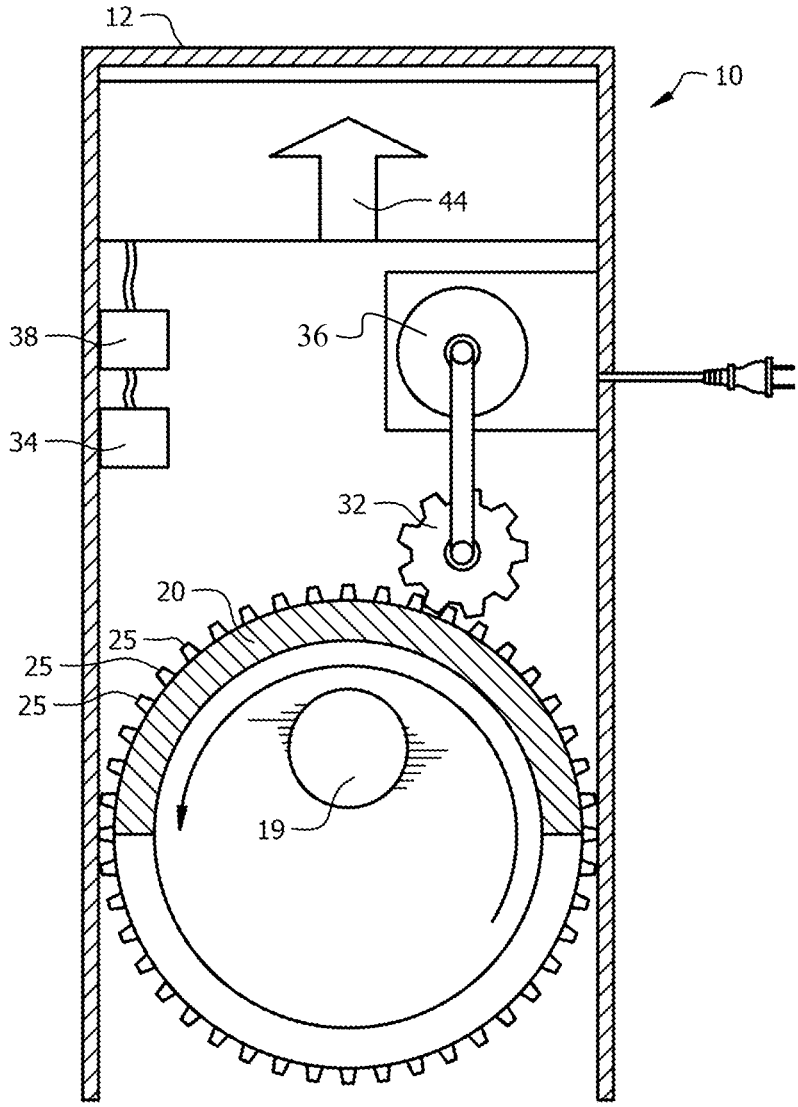
FIG. 4 is a cross-sectional view of an embodiment using an electric motor.

A wide array of mechanisms may be used to actuate door 20. Some possible mechanisms are illustrated in FIGS. 4-6. In these embodiments of pipe clearing apparatus 10, a gear wheel 32 is rotationally attached to the inner surface of housing 12. The teeth of gear wheel 32 engage gear teeth 25 of annular end 24 of door 20. Gear wheel 32 is adapted to drive annular end 24 causing door 20 to rotate about its center axis. Alternative embodiments may utilize cable-pulley or other mechanical systems instead of the gear system. A person of ordinary skill in the art will appreciate that various known methods of translating mechanical work are known in the art and fall within the scope of the present invention.

Alternatively, an electric magnet may be used to operate door 20. In such embodiment, door 20 would contain one or more pieces of a magnetically-attractive material causing the door to open when an electric magnet housed within housing 12 is actuated. A combination of a magnetic and mechanical actuation mechanism is also within the scope of the invention.

EXAMPLE 1

The embodiment depicted in FIG. 4 involves an electrical power source 34, an electric motor 36, and a switch module 38. Electrical power source 34 is used to provide electric energy to switch module 38, electric motor 36, and vacuum pump 30. Electrical power source 34 may be a battery, a source of an alternating current (such as a household electrical outlet), or a capacitor.

In an embodiment depicted in FIG. 1B, a solar panel 40 may be used to charge the electrical power source 34. This embodiment of pipe clearing device 10 is virtually maintenance free since the battery will not have to be replaced. Where necessary or practicable, solar panel 40 may be placed on the roof of a building to increase its exposure to sunlight. Since electrical outlets are not always readily available outside a building, the embodiment utilizing a battery is preferable to facilitate easy and convenient installation of pipe clearing device 10.

Continuing reference to FIG. 4, electric motor 36 is connected to gear wheel 32 by means of translating rotational energy, such as a belt 33. Switch module 38 may include a CPU programmed to automatically actuate electric motor 36 and vacuum pump 30 at predetermined times and for predetermined duration. Switch module 38 may be programmed to bring pipe clearing device 10 into operation at scheduled times—for example, once a month, once every other month, etc. In an alternative embodiment, switch module 38 may be actuated manually.

Switch module 38 is preferably programmed to first bring electric motor 36 into operation until door 20 is fully closed. At that point, switch module 38 turns off electric motor 36 and actuates vacuum pump 30 for a predetermined duration to extract buildup from pipe 16. Then, switch module 38 turns off vacuum pump 30 and actuates electric motor 36 to bring door 20 back to its open position.

In an embodiment where gear teeth 25 are disposed along the entire circumference of annular end 24, electric motor 36 may rotate in the same direction to both close and open door 20. However, if gear teeth 25 are disposed on less than entire circumference of annular end 24, electric motor 36 must rotate in one direction to close door 20 and in the opposite direction to open it.

EXAMPLE 2

Figure 5A:
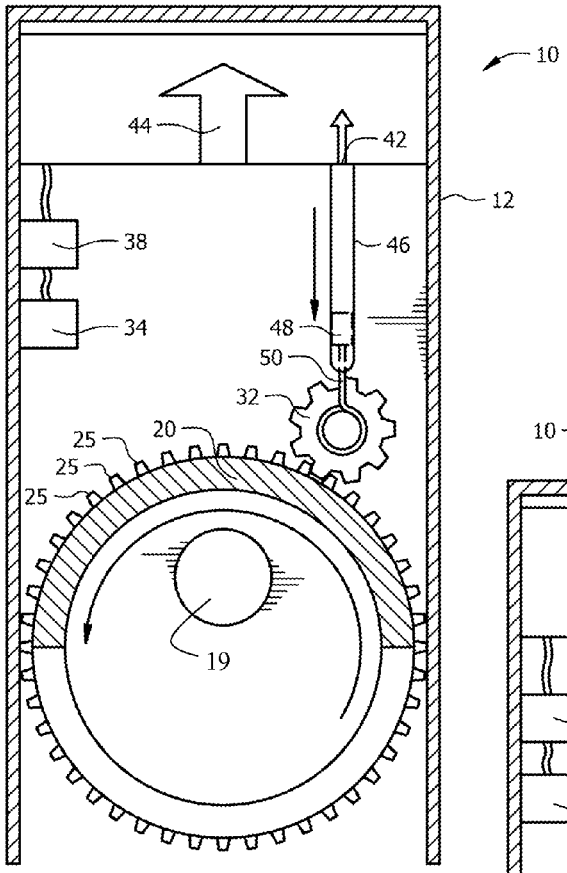
FIG. 5A is a cross-sectional view of an embodiment involving the vacuum pump having two air intakes with the door in an open position.
Figure 5B:
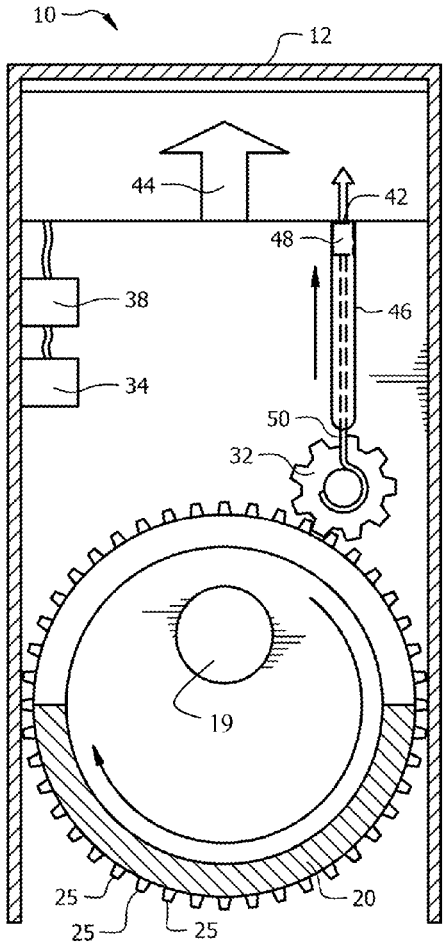
FIG. 5B is a cross-sectional view of the embodiment involving the vacuum pump having two air intakes with the door in a closed position.

Another embodiment of pipe clearing apparatus 10 is shown in FIGS. 5A-B. In this embodiment electric motor 36 is eliminated. Instead, vacuum pump 30 includes a first air intake 42 and a second air intake 44. First air intake 42 is sealingly attached to a tube 46. A piston 48 is slidingly disposed within tube 46, whereby vacuum produced within the tube by first air intake 42 causes piston 48 to rise. Piston 48 is connected to gear wheel 32 via a pulley-cable system 50, whereby as piston 48 rises, gear wheel 32 rotates, causing door 20 to close as shown in FIG. 5B. In this embodiment, door 20 is biased toward an open position by a biasing element, such as a coil spring. Accordingly, when vacuum pump 30 is turned off, the biasing element returns door 20 to its open position shown in FIG. 5A. In alternative embodiments, gear wheel 32 and gear teeth 25 may be eliminated, and a cable-pulley or another mechanical system may be used instead.

In a variation of the embodiment depicted in FIGS. 5A-B, switch module 38 actuates first air intake 42 to close door 20. After door 20 is closed, switch module 38 actuates second air intake to clear pipe 16.

In an alternative embodiment, both air intakes 42 and 44 are actuated simultaneously. This embodiment may lose some efficiency due air intake 44 operating while door 20 is not fully closed, thus intaking air from the bottom opening of housing 12 and not creating a vacuum within the housing due to absence of a sealed enclosure. However, a major advantage of this embodiment is that vacuum pump 30 may be simplified because air intakes 42 and 44 are not required to operate independently of each other.

In yet another embodiment, second air intake 44 may be turned on by an actuator positioned inside tube 46. The actuator may be adapted to be triggered by piston 48 when piston 48 rises to a position within tube 46 corresponding to door 20 being fully closed.

EXAMPLE 3

Another embodiment of pipe clearing apparatus 10 is showed in FIG. 6. This embodiment does not have a semi-cylindrical hollow door 20. Instead, a v-shaped door 50 is pivotally disposed within housing 12, whereby v-shaped door 50 pivots about pivot axis 52. V-shaped door 50 comprises an upper member 54 and a lower member 56, wherein lower member 56 is wider than the bottom opening of housing 12, so that when v-shaped door 50 pivots up, lower member 56 engages an edge of housing 12 closing the bottom opening.

Upper member 54 serves functions of facilitating pivoting of door 50 into the closed position and covering the components housed inside housing 12.

In an alternative embodiment, door 50 may comprise only lower member 56. In yet another embodiment (not shown), door 50 may comprise two parts, each hingedly attached to an opposite side of the housing. The vacuum pressure causes the two parts to pivot up into position where they sealingly mate with each other, forming a sealed enclosure within housing 12.

Figure 6A:
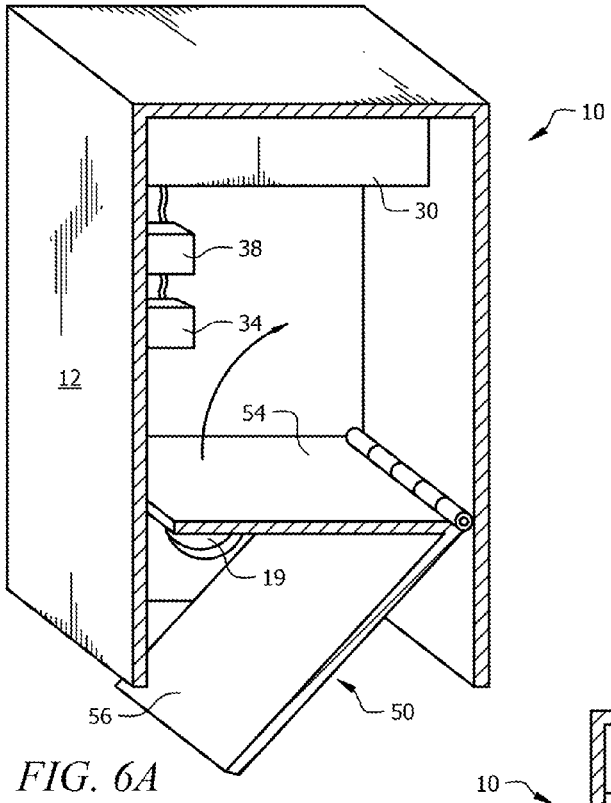
FIG. 6A is a perspective cross-sectional view of an embodiment involving a v-shaped door where the door is in an open position.

Analogously to the embodiments shown in FIGS. 2 and 4-5, v-shaped door 50 has an open position and a closed position. In FIG. 6A, door 50 is depicted in its open position where upper member 54 is substantially horizontally positioned above discharge conduit 14 and lower member 56 leaves the bottom opening of housing 12 partially opened, so that condensate may drain normally form discharge conduit 14. In its open position upper member 54 may rest on pipe extension 18.

Figure 6B:
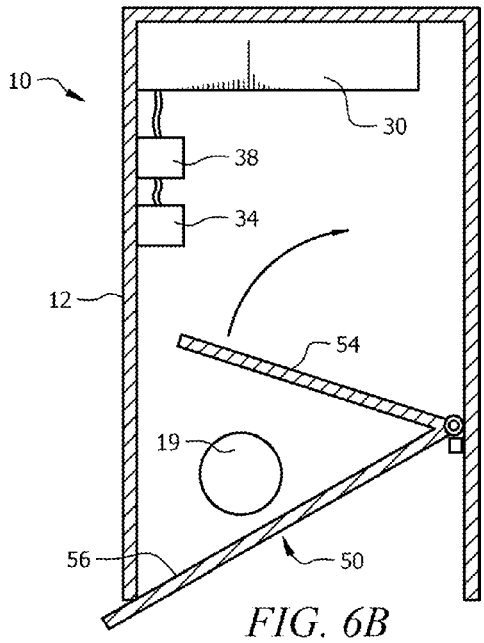
FIG. 6B is a cross-sectional view of the embodiment involving a v-shaped door where the door is in a closed position.

The embodiment involving v-shaped door 50 also utilizes vacuum pump 30, electrical power source 34, and switch module 38. Analogously to other embodiments, switch module 38 is programmed to periodically automatically actuate vacuum pump 30 at a predetermined time and for a predetermined duration. When vacuum pump 30 is operating, the air suction causes v-shaped door 50 to pivot upwards into the closed position. In the closed position, lower member 56 engages a bottom edge of housing 12, thus closing the bottom opening of housing 12, as shown in FIG. 6B. In this configuration, discharge conduit 14 is sealingly enclosed within housing 12.

The continuous air suction produced by vacuum pump 30 retains v-shaped door 50 in the closed position. Once the v-shaped door sealingly closes the bottom opening of housing 12, the only source of air intake for vacuum pump 30 is through discharge conduit 14. Accordingly, the vacuum created within the housing by vacuum pump 30 extracts the buildup from pipe 16, which is fluidly coupled to discharge conduit 14.

After vacuum pump 30 has operated for a predefined duration sufficient to extract buildup from pipe 16, switch module 38 turns vacuum pump 30 off. After the suction is discontinued, v-shaped door 50 pivots down to its open position due to its own weight. Pipe 16 continues to drain normally with condensate exiting the pipe through discharge conduit 14 and leaving housing 12 through the bottom opening.

The embodiment shown in FIGS. 6A-B contains fewer electrical components and moving parts than embodiments depicted in FIGS. 4-5. Furthermore, the programming of switch module 38 is also significantly simplified because the only function that switch module 38 must perform is actuating vacuum pump 30 and turning it off at scheduled times. Accordingly, the embodiment of pipe clearing apparatus 10 depicted in FIGS. 6A-B may lead to decreased manufacturing and operational costs, increased reliability, and longer life.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

GLOSSARY OF TERMS

Automatic—working by itself with no direct human control other than initial programming of a set of instructions.

Switch module—a component that actuates other components.

Center axis—an imaginary line passing through centers of annular ends.

Conduit—a tube for conveying a fluid.

Buildup—accumulation of debris, fungus, algae, dust, sludge, mold or other substance capable of clogging a pipe.

Discharge conduit—a tube through which a fluid is discharged.

Door—a hinged, sliding, or revolving barrier that encloses an interior space.

Electric motor—an electric machine that convers electricity to mechanical work.

Electrical communication—an electrical connection between at least two components where the electrons may flow between the components.

Electrical power source—an element capable of storing and releasing electricity.

Face—a side of a structure.

Fluid coupling—a connection between two components whereby fluid may flow between the components, but does not escape at the point of connection.

Housing—a structure at least partially inclosing an amount of space adapted to contain components of a device.

Mechanical communication—a relationship between two or more components that transfers mechanical energy from one component to the other.

Open face—an uncovered side of a structure that exposes the interior of the structure.

Piston—a member fitting closely within a tube in which it moves along.

Sealingly—not permitting fluids to enter or exit.

Semi-cylindrical hollow body—a member whose shape may be described by a hollow cylinder that was cut longitudinally along a diameter.

Suction—the production of partial vacuum by the removal of air in order to force fluid into a vacant space.

Tube—an elongated hollow member for holding or transporting a piston.

Vacuum pump—a pump used for creating a vacuum

What is claimed is:

1. A pipe clearing apparatus comprising:

a housing having an enclosed top face, enclosed side faces, and an open bottom face;

a discharge conduit fluidly coupled to the housing, the discharge conduit having a first end positioned inside the housing proximate to the open bottom face and a second end outside the housing, the second end configured to fluidly couple to a condensation drain conduit;

a door disposed at the open bottom face of the housing forming a door-housing assembly, the door having a first, open position wherein condensation drains due to gravity and exits the housing through the open bottom face thereof, and a second, closed position wherein the drain conduit is sealingly enclosed within the housing by closing the door to substantially fluidly seal the open bottom face;

a vacuum pump having an inlet within the housing and an outlet outside the housing;

an electrical power source in electrical communication with the vacuum pump; and a switch module in electrical communication with the electrical power source and vacuum pump, the switch module actuating the door-housing assembly into the closed position and turning on the vacuum pump, thereby creating a vacuum within the condensation drain conduit to extract buildup from the condensation drain conduit before the vacuum is turned off and then door-housing assembly returns to the open position, wherein the apparatus is configured for permanent in-situ operation.

2. A pipe clearing apparatus according to claim 1, further comprising the switch module being configured to automatically actuate the door-housing assembly and the vacuum pump at a predetermined time.

3. A pipe clearing apparatus according to claim 1, further comprising the switch module having a central processing unit programmable to actuate the door-housing assembly and the vacuum pump at a predetermined time.

4. A pipe clearing apparatus according to claim 1, further comprising the door having a first annular end, a second annular end, a semi-cylindrical hollow body, and a center axis, the door configured to rotate about the center axis to transition between the open and the closed positions.

5. A pipe clearing apparatus according to claim 1, further comprising an electric motor in electrical communication with the electrical power source, the electric motor configured to transition the door-housing assembly between the open and the closed positions.

6. A pipe clearing apparatus according to claim 4, further comprising the switch module being configured to automatically control the electric motor to synchronize operation of the vacuum pump with the door-housing assembly, wherein the vacuum pump operates when the door-housing assembly is in the closed position.

7. A pipe clearing apparatus according to claim 1, further comprising: the vacuum pump having a second inlet; a tube fluidly coupled to the second inlet; and a piston slidingly disposed within the tube, the piston configured to advance within the tube when the second inlet is producing suction, the piston being in mechanical communication with the door, whereby advancement of the piston causes the door to close.

8. A pipe clearing apparatus according to claim 1, further comprising a biasing element urging the door into the open position.

9. A pipe clearing apparatus according to claim 1, further comprising the door being hingedly disposed within the housing, whereby suction produced by the vacuum pump causes the door to pivot into the closed position.

10. A pipe clearing apparatus according to claim 1, further comprising an electric magnet disposed within the housing in electrical communication with the power source and switch module, the electric magnet being configured to actuate the door-housing assembly.

11. A pipe clearing apparatus according to claim 1, further comprising the electrical power source being selected from the group consisting of a battery, an alternating electrical current source, and a capacitor.

12. A pipe clearing apparatus according to claim 1, further comprising a solar panel in electrical communication with the electrical power source, the solar panel configured to charge the electrical power source.

13. A pipe clearing apparatus according to claim 1, further comprising the housing being configured to attach to an exterior wall of a building.

14. A pipe clearing apparatus according to claim 1, further comprising a temperature sensor in an electrical communication with the switch module, the temperature sensor configured to prevent the switch module from actuating the vacuum pump and the door-housing assembly when the ambient temperature is below a predetermined temperature.

15. A pipe clearing apparatus according to claim 1, further comprising the condensation drain conduit being a part of an air conditioning system or a refrigeration system.

* * * * *